US009139353B2

(12) United States Patent
Glass et al.

(10) Patent No.: US 9,139,353 B2
(45) Date of Patent: Sep. 22, 2015

(54) GIFT CARD HOLDER SHAPED TO ASSOCIATE CUSTOMER WITH MERCHANT PRODUCT

(75) Inventors: Brett R. Glass, Overland Park, KS (US); Nicole E. Glass, Overland Park, KS (US)

(73) Assignee: Gift Card Impressions, LLC, Kansas City, MO (US)

( * ) Notice: Subject to any disclaimer, the term of this patent is extended or adjusted under 35 U.S.C. 154(b) by 317 days.

(21) Appl. No.: 13/526,489

(22) Filed: Jun. 18, 2012

(65) Prior Publication Data

US 2013/0153454 A1 Jun. 20, 2013

Related U.S. Application Data

(60) Provisional application No. 61/498,503, filed on Jun. 17, 2011.

(51) Int. Cl.
*B65D 85/00* (2006.01)
*B65D 81/36* (2006.01)

(52) U.S. Cl.
CPC ..... *B65D 85/00* (2013.01); *B65D 81/365* (2013.01)

(58) Field of Classification Search
CPC ..... B65D 85/00; B65D 81/365; B65D 5/522; B65D 5/4212; B65D 73/0064
USPC ..... 206/457, 39, 767, 768, 758, 759, 756, 206/806; 235/380
See application file for complete search history.

(56) References Cited

U.S. PATENT DOCUMENTS

| | | | | |
|---|---|---|---|---|
| 5,971,157 | A * | 10/1999 | Howell et al. | 206/755 |
| 6,619,480 | B2 * | 9/2003 | Smith | 206/555 |
| 6,732,459 | B1 * | 5/2004 | Clark | 40/124.06 |
| 6,877,263 | B2 * | 4/2005 | Clark | 40/124.06 |
| 7,607,575 | B2 * | 10/2009 | Kingsborough et al. | 235/380 |
| 2004/0093773 | A1 * | 5/2004 | Clark | 40/124.06 |
| 2005/0279825 | A1 * | 12/2005 | Ashby et al. | 235/380 |
| 2009/0038968 | A1 * | 2/2009 | Smith | 206/307 |
| 2013/0126371 | A1 * | 5/2013 | Glass et al. | 206/232 |
| 2013/0220878 | A1 * | 8/2013 | Glass et al. | 206/756 |
| 2013/0277246 | A1 * | 10/2013 | Glass et al. | 206/232 |
| 2014/0054187 | A1 * | 2/2014 | Glass et al. | 206/307 |
| 2014/0216982 | A1 * | 8/2014 | Boyer | 206/758 |

OTHER PUBLICATIONS

"Happy Birthday! Coffee Cup Slider Card Tutorial". Oct. 4, 2010. http://creativecucina.com/tag/coffee/.*
"Christmas Coffee Cup Pocket Card". Oct. 8, 2010. http://wizardshangout.blogspot.com.au/2010/10/christmas-coffee-cup-pocket-card.html.*

* cited by examiner

*Primary Examiner* — Steven A. Reynolds
(74) *Attorney, Agent, or Firm* — Polsinelli PC

(57) ABSTRACT

A transaction card holder for holding a transaction card, such as a gift card, on or within an insert that may be withdrawn from an enclosing main body of the holder. The holder is shaped to associate a transaction card with a product related to the transaction card via marketing, subject matter, point of sale placement or the like. The holder includes a sleeve sized for receiving and holding a sliding insert, an outer surface or outer conformation shaped to evoke the related product and may include one or more enhancement elements such as graphics and text upon the holder surfaces.

13 Claims, 5 Drawing Sheets

GIFT CARD HOLDER SHAPED TO ASSOCIATE CUSTOMER WITH MERCHANT PRODUCT

CROSS REFERENCE TO RELATED APPLICATIONS

This application claims the benefit of the prior filed, provisional application, Ser. No. 61/498,503, filed Jun. 17, 2011.

BACKGROUND OF THE INVENTION

This invention relates generally to gift card holders and more particularly to a device for holding a gift card while providing graphical and mechanical enhancements to entertain the gift card recipient and add value to the gift.

Transaction cards, stored value cards, or gift cards, as they are commonly called based upon their intended use, have become popular gifts. Gift cards typically comprise a stored value card whereby a certain cash equivalent value is encoded upon a magnet strip applied to the surface of the card. This stored value may be determined by the vendor prior to packaging and display for sale or, more commonly, is selected at the point of sale by the purchaser and loaded by the cashier using a magnet card reader/writer. While popular, gift cards are typically provided with a generic and impersonal design, typically identifying the associated merchant for which the card may be used to purchase merchandise, and therefore are not personalized in view of the intended recipient.

Gift cards are often presented for sale on display racks in stores, each card or packet of cards being hung upon a display stand peg. A given area of a store will only support a certain number and size of display stands, given store traffic and other considerations, which makes allocation of display space an important marketing decision that may require selecting only certain high selling cards for display. Display of other items in the same store area will typically reduce the substantially finite space available for displaying gift cards and gift card packets.

In addition to the above considerations, gift card packets must fit within a set, allocated space in pre-existing displays. A gift card packet must not exceed 5.25" tall and 4" wide. These dimensions are an industry standard and are typically non-negotiable. In order to properly hang each gift card packet, the packet typically includes a J-hook hole (sombrero cut) with the exact dimensions of 1.875" wide by 0.5" high and be placed 0.1875" from the top of the packet. Presently, the above requirements pertain to approximately 95% of all gift cards and gift card packets that are sold at retail.

What is needed, therefore, is a device capable of readily holding a gift card and providing graphical and mechanical enhancements to entertain the gift card packet recipient and enhance the value of the gift card to the recipient.

BRIEF DESCRIPTION OF THE INVENTION

The purpose of this invention is to provide a holder for receiving and holding a gift card. The holder includes a sleeve sized for receiving and holding a sliding insert and may include one or more enhancement elements such as graphics and text upon the holder surfaces. One embodiment of the invention is directed to a transaction card holder assembly including a sleeve having a profile in the shape of a cup, an insert held within the sleeve and which may be partially withdrawn from the sleeve. The upper portion of the insert is in the shape of a lid of a cup so that when the insert is fully retracted within the sleeve, the sleeve and insert cooperate to present a transaction card holder bearing a likeness to a disposable coffee cup. A detachable header projects from a panel of the sleeve so that the holder may be hung upon a display rack for sale. The insert includes slots or other means for attaching a transaction card to the insert.

Other advantages of the invention will become apparent from the following description taken in connection with the accompanying drawings, wherein is set forth by way of illustration and example an embodiment of the present invention.

DETAILED DESCRIPTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
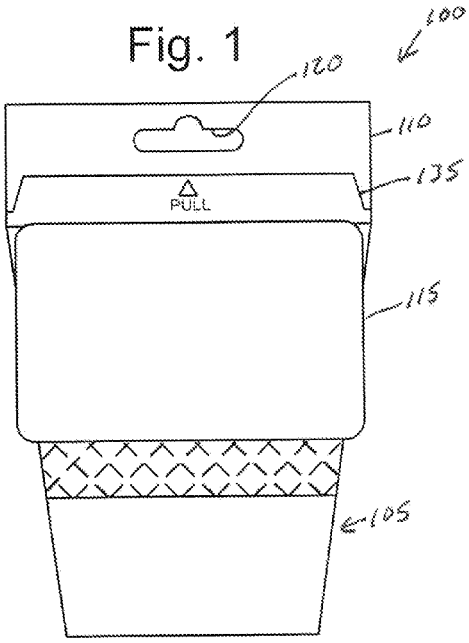
FIG. 1 is a front view of a cup-shaped gift card holder attached to a hang tag header panel and with a gift card attached to the front of the holder to form a gift card holder assembly.
Figure 2:
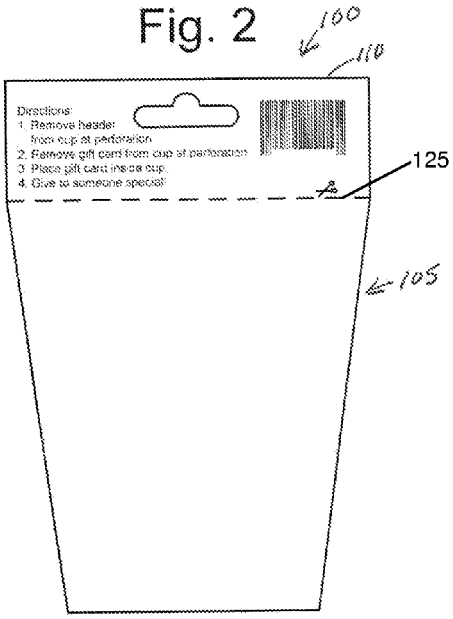
FIG. 2 is a rear view of the gift card holder assembly.
Figure 3:
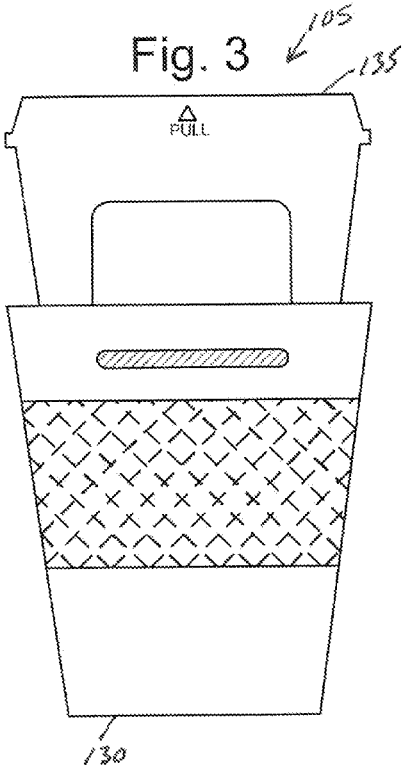
FIG. 3 is a front view of the gift card holder showing a sliding panel insert partially withdrawn from an enclosing sleeve.

With reference to the figures, FIGS. 1 through 17 are illustrations of various embodiments of a gift card holder shaped to associate, as perceived by a user, a transaction card with a product related to the transaction card via marketing, subject matter, point of sale placement or the like. FIG. 1 is a front view of a first embodiment of a gift card holder assembly 100 including a cup-shaped gift card holder 105 attached to a hang tag or header 110. A gift card 115 is attached to the front of the holder 105. The holder 105, header 110, and gift card 115 are combined to form the gift card holder assembly 100, which is typically hung for display upon a display rack (not shown) at a point of purchase. The header 110 includes a sombrero-cut hole 120 for receiving the display rack peg. FIG. 2 is a rear view of the gift card holder assembly 100 showing a perforation line 125 that defines the header 110 from the holder 105. FIG. 3 is a front view of the gift card holder 105. The holder 105 comprises a sleeve 130 that holds and encloses a sliding insert 135. Typically, the header 110 and sleeve 130 are die cut as a unit from a single piece of cardstock or other relatively heavy weight paper material or other operable material.

FIG. 3 shows the sliding insert 135 partially withdrawn from the sleeve 130. The insert 135 includes sufficient space on a forward surface thereof to receive and hold the gift card 115 prior to giving the holder 105 and gift card 115 to a gift recipient.

Figure 11:
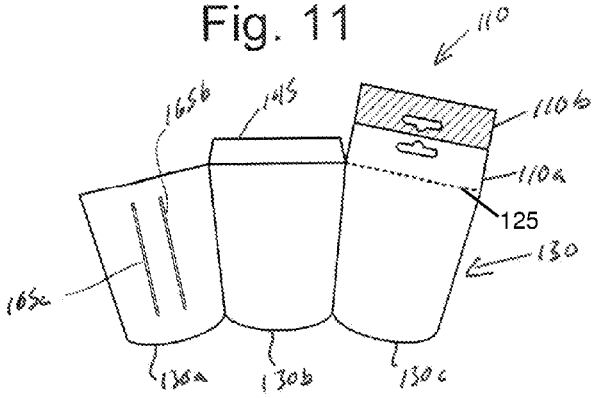
FIG. 11 is a plan view of the unassembled sleeve die cut from cardstock.

FIG. 11 is a plan view of the unassembled sleeve 130 die cut from cardstock. As shown, the sleeve 130 comprises three hinged panels, a left panel 130*a*, a center panel 130*b*, and a right panel 130*c*. The header 110 comprises two hinged panels, a proximate panel 110*a* that projects from the top margin of the sleeve right panel 130*c*, and a hingedly connected distal panel 110*b* that projects from the proximate panel 110*a*.

Figure 12:
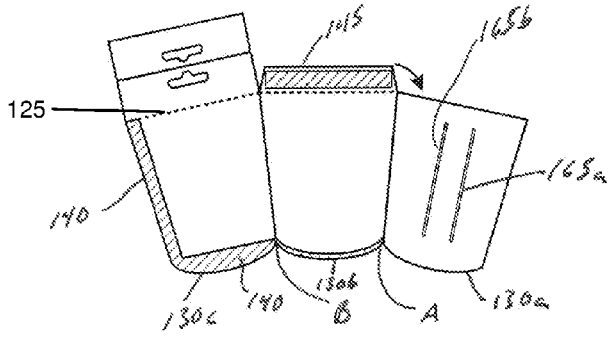
FIG. 12 is a plan view of the reverse side of the unassembled sleeve of FIG. 4.

FIG. 12 is a plan view of the reverse side of the unassembled sleeve 130 of FIG. 11. To assemble the sleeve 130, panel 130*a* is folded inward about fold line A to rest upon panel 130*b* and then folded further inward about fold line B to rest upon panel 130*c* and contact adhesive surfaces 140. Panel 130*a* is thereby adhered to the inner surface of panel 130*c* at surfaces 140.

A tab 145 projects from the upper margin of panel 130*b*. During assembly, the tab 145 is folded downward to rest upon the upper portion of the outer surface of panel 130*b*. As shown, the outer surface of tab 145 is provided with removable or temporary adhesive for holding the gift card 115 when the assembly 100 is formed, as shown in FIG. 1.

Figure 13:
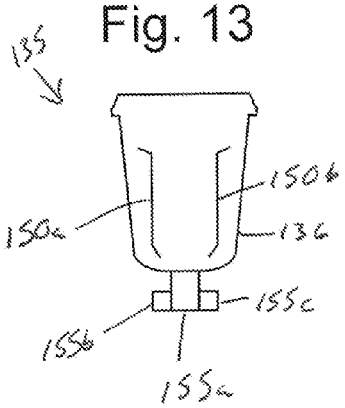
FIG. 13 is a plan view of an unassembled sliding panel insert.
Figure 14:
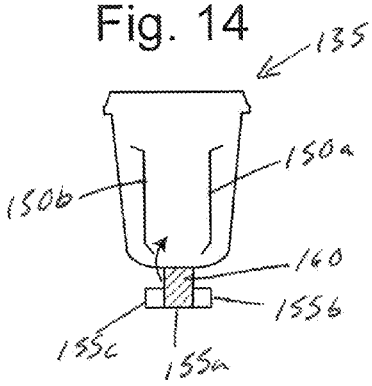
FIG. 14 is a plan view of the reverse side of the insert of FIG. 6.

FIG. 13 is a plan view of an unassembled sliding insert 135. The insert 135 comprises a panel 136 of cardstock, or similar material as described above, and includes slits 150 for receiving and holding the gift card 115. A primary tab 155*a* projects from the lower margin of the insert panel 136 and two transversely opposed secondary tabs 155*b* and 155*c* project outward from opposing sides of the primary tab 155*a*. As shown in FIG. 14, a surface of the primary tab 155*a* bears adhesive 160 and during assembly the primary tab 155*a* is folded upward to adhere to a lower portion of the panel 136. The secondary tabs 155*b* and 155*c* are then fitted into parallel slots 165*a* and 165*b* in panel 130*a*. During operation of the gift card holder 105, the tabs 155*b* and 155*c* ride and their associated slots 165*a* and 165*b* so that the insert 135 may be drawn in or out of the sleeve 130 without becoming frilly disengaged.

Figure 4:
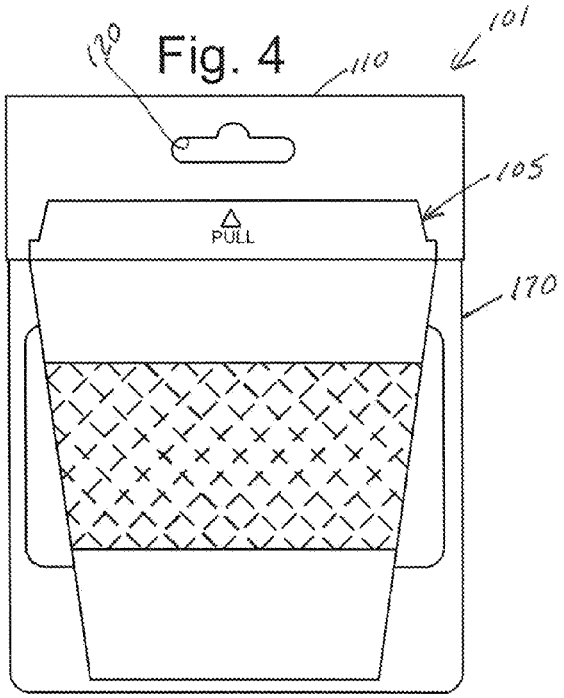
FIG. 4 is a front view of a second alternative embodiment of a gift card holder assembly showing a cup-shaped gift card holder attached to a header panel with associated backer panel.
Figure 5:
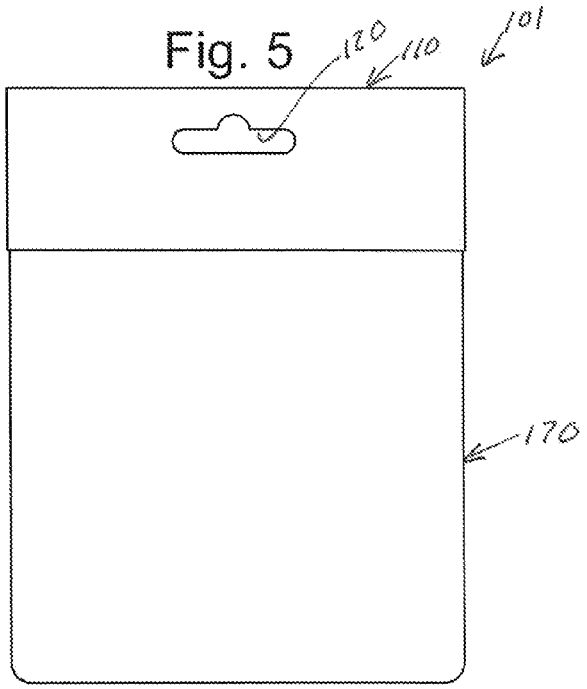
FIG. 5 is a rear view of the gift card holder assembly of FIG. 4 showing the rear surface of the header panel and the rear surface of the backer panel.
Figure 6:
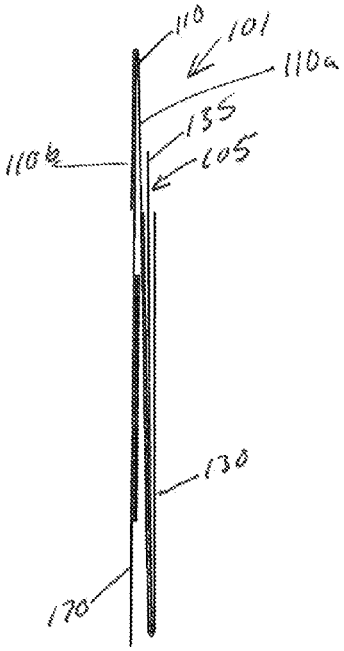
FIG. 6 is a cross sectional diagram of the holder assembly of FIGS. 4 and 5 showing the backer panel held within the subpanels and of the header.

FIG. 4 is a front view of a second alternative embodiment of a gift card holder assembly 101 showing a cup-shaped gift card holder 105 attached to a header panel 110 with associated backer panel 170. When the assembly 101 is assembled for sale, the gift card 115 is attached to the front surface of the backer panel 170 and lies underneath the sleeve 130 of the holder 105. The gift card 115 is moved and installed upon the insert 135 prior to giving the holder 105 bearing the gift card to a recipient. FIG. 5 is a rear view of the gift card holder assembly 101 of FIG. 4 showing the rear surface of the header panel 110 and the rear surface of the backer panel 170. FIG. 6 is a cross sectional diagram of the holder assembly 101 of FIGS. 4 and 5 showing the backer panel 170 held within the subpanels 110*a* and 110*b* of the header 110. Proximate panel 110*a* projects from the top margin of the forward panel of the sleeve 130, and a hingedly connected distal panel 110*b* that projects downward from the upper margin of the proximate panel 110*a*. In this embodiment, the backer panel 170 is attached to the inside surface of the distal panel 110*b*. The sleeve 130 may be removed from the proximate panel 110*a* prior to gifting the holder 101 by tearing or cutting along a line (which may be marked in ink and/or by a line of perforations) separating the proximate panel 110*a* from the sleeve 130.

Figure 7:
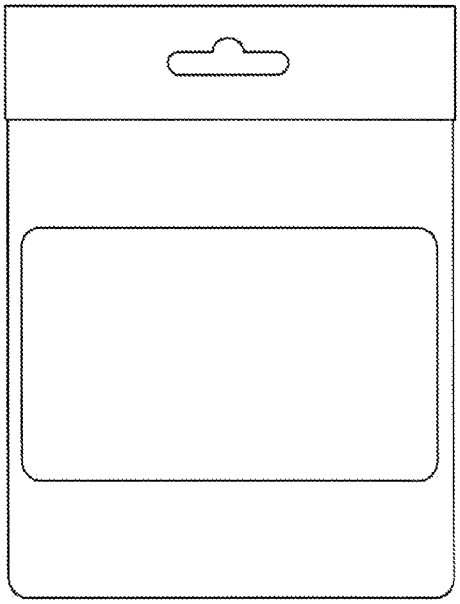
FIG. 7 is a front view of a third alternative embodiment of a gift card holder assembly showing a front flap or panel attached to a header panel.
Figure 9:
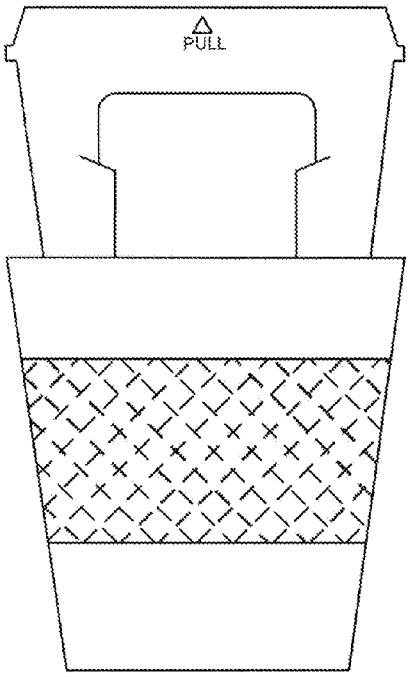
FIG. 9 is a front view of the gift card holder showing a sliding panel insert partially withdrawn from an enclosing sleeve.
Figure 8:
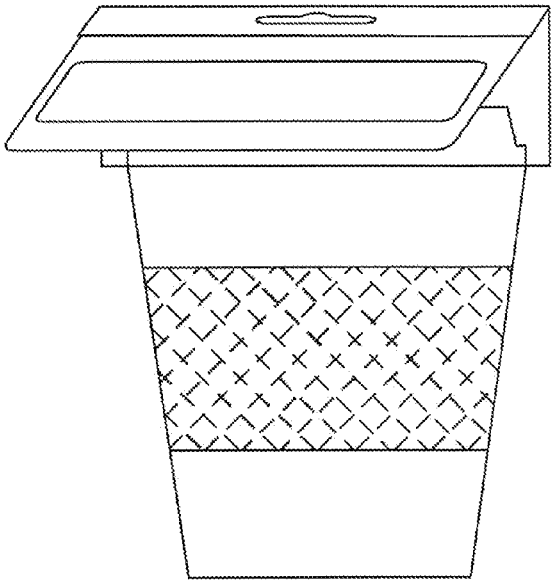
FIG. 8 is a front perspective view of the assembly of FIG. 15 showing the front flap lifted upward to reveal a cup-shaped gift card holder attached to the header.
Figure 10:
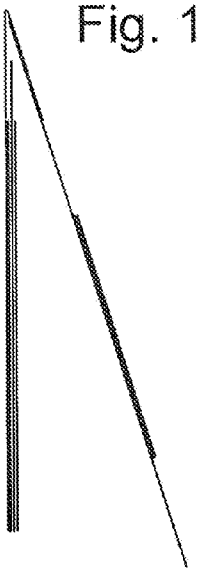
FIG. 10 is a cross sectional diagram of the holder of FIGS. 7 and 9.

FIG. 7 is a front view of a third alternative embodiment of a gift card holder assembly showing a front flap or panel attached to a header panel. FIG. 8 is a front perspective view of the assembly of FIG. 7 showing the front flap lifted upward to reveal a cup-shaped gift card holder attached to the header. FIG. 9 is a front view of the gift card holder showing a sliding panel insert partially withdrawn from an enclosing sleeve. FIG. 10 is a cross sectional diagram of the holder of FIGS. 7 and 9.

Figure 15:
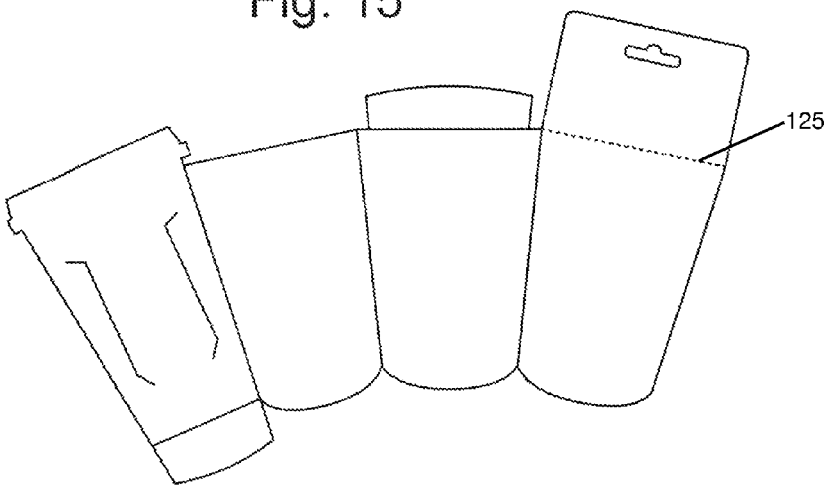
FIG. 15 is a plan view of a fourth embodiment of an unassembled gift card holder assembly die cut from cardstock.
Figure 16:
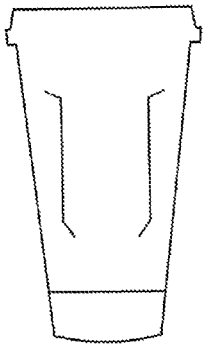
FIG. 16 is a plan view showing the insert cut or otherwise separated from the sleeve portion of the holder.
Figure 17:
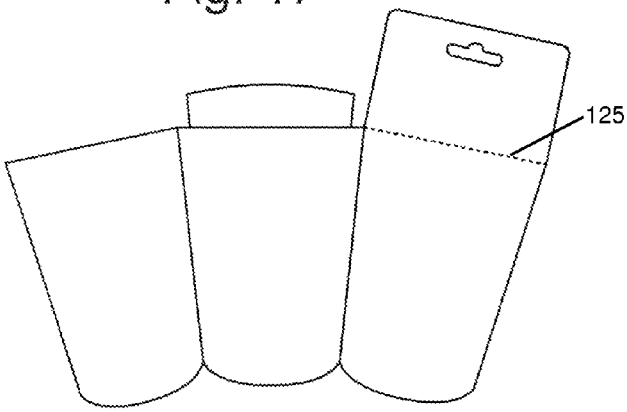
FIG. 17 is a plan view showing the sleeve portion of the holder after the insert has been separated.

FIG. 15 is a plan view of a fourth embodiment of an unassembled gift card holder assembly die cut from cardstock. As shown, the insert and sleeve portions are cut as a unit from a single sheet of cardstock or equivalent material. FIG. 16 is a plan view showing the insert cut or otherwise separated from the sleeve portion of the holder and FIG. 17 is a plan view showing the sleeve portion of the holder after the insert has been separated.

Note that the figures are not necessarily drawn to scale or to relative scale but are representative of aspects of one or more embodiments of the present invention.

Having thus described the invention, what is claimed as new and desired to be secured by Letters Patent is:

1. A transaction card holder assembly comprising:

a sleeve having a profile in the shape of a cup;

an insert held within said sleeve and which may be partially withdrawn from said sleeve;

said insert having an upper portion, said upper portion having the shape of a lid of a cup;

where the insert further comprises a primary tab projecting away from a lower margin of the insert and two transversely opposed secondary tabs projecting outward from the primary tab and wherein the secondary tabs are received in parallel slots of the sleeve to allow translation of the insert within the pocket while preventing complete removal of the insert from the pocket;

a header projecting from a panel of said sleeve; and means for attaching a transaction card to said insert.

2. A transaction card holder assembly comprising:

a sleeve including a proximal portion and a distal portion where the distal portion has a distal width greater than a proximal width such that the sleeve has a tapered form;

an insert including a proximal insert portion and a distal insert portion where the distal portion has a distal insert width greater than a proximal insert width such that the insert has a tapered insert formed, and the insert configured to receive a transaction card; and the insert slidably received in the distal portion of the sleeve such that the insert may be disposed within the sleeve.

3. The transaction card holder assembly of claim 2 further comprising a header removably engaged to the sleeve.

4. The transaction card holder assembly of claim 1 wherein the transaction card is removably engaged to a front surface of the sleeve in a first configuration.

5. The transaction card holder assembly of claim 1 wherein the transaction card is removably engaged to a front surface of the sleeve in a point of purchase configuration.

6. The transaction card holder assembly of claim 1 wherein the transaction card is removably engaged to the insert in a use configuration.

7. The transaction card holder assembly of claim 6 where, in the use configuration, the insert disposed within the sleeve is translated away from the sleeve to reveal the transaction card removably engaged to the insert.

8. A transaction card holder assembly comprising:

a sleeve comprising a first panel hingedly engaged to a second panel along a first fold line, and a third panel hingedly engaged to the second panel along a opposite the first panel along a second fold line, where the first panel is rotated about the first fold line, and the third panel is folded about the second fold line to form a pocket between the third panel and the second panel with the first panel disposed between the second panel and the third panel;

an insert including one or more slits to receive a transaction card, where the inset is slidable engaged to the first panel with in the pocket; and where the insert further comprises a primary tab projecting away from a lower margin of the insert and two transversely opposed secondary tabs projecting outward from the primary tab and wherein the secondary tabs are received in parallel slots of the first panel to allow translation of the insert within the pocket while preventing complete removal of the insert from the pocket.

9. The transaction card holder assembly of claim 8 where second panel and the third panel are adhered to one another about a bottom margin and a side margin of the second panel proximal to the first fold line.

10. The transaction card holder assembly of claim 8, where first, second, and third panels are defined within a single planar material.

11. The transaction card holder assembly of claim 10, where the insert is defined in the single planar material.

12. The transaction card holder assembly of claim 8, where second panel comprises a tab projecting away from an upper margin of the second panel, the tab to removable engage a transaction card in a point-of-purchase configuration.

13. The transaction card holder assembly of claim 8, wherein the sleeve comprises a indicia, ornamentation and a shape resembling a product sold by a merchant associated with the transaction card.

* * * * *